United States Patent [19]

Strauss

[11] 4,311,448

[45] Jan. 19, 1982

[54] SMOKING ELIMINATION GUIDANCE SYSTEM

[76] Inventor: Edward Strauss, 2828 N. Pine Grove, Chicago, Ill. 60657

[21] Appl. No.: 135,228

[22] Filed: Mar. 31, 1980

[51] Int. Cl.[3] ..... F23N 5/26

[52] U.S. Cl. ..... 431/14; 431/86; 431/253; 340/309.1; 340/527; 368/10; 364/705

[58] Field of Search ..... 431/13, 14, 73, 86, 431/253, 277; 70/273; 368/10; 340/309.1, 309.4, 527, 789, 323; 364/705

[56] References Cited

U.S. PATENT DOCUMENTS

| | | | |
|---|---|---|---|
| 3,806,911 | 4/1974 | Pripusich | 340/802 |
| 4,111,638 | 9/1978 | Ostberg | 431/13 |
| 4,209,977 | 7/1980 | Yoshinaga | 431/253 X |

FOREIGN PATENT DOCUMENTS

| | | | |
|---|---|---|---|
| 2828682 | 1/1980 | Fed. Rep. of Germany | 431/73 |
| 450505 | 7/1912 | France | 431/86 |

*Primary Examiner*—Samuel Scott

*Assistant Examiner*—Randall L. Green

*Attorney, Agent, or Firm*—Russell E. Hattis

[57] ABSTRACT

The smoking elimination guidance system of the invention, which is preferably incorporated in a cigarette lighter, includes a timer which is responsive to each operation of the cigarette lighter automatically to initiate a new predetermined timing period during which only a single cigarette is to be smoked. Indicator means visible on the outside of the cigarette lighter indicate to the user when the end of the current timing period is reached. Timing period modifying means are provided for automatically at various times progressively increasing the timing period initiated by the operation of the cigarette lighter, such as by a predetermined fixed percentage. Before the timer starts into operation, a smoking elimination program suitable to the user is selected automatically during a measurement period when the user's cigarette smoking rate is determined. The selected program sets the initial timing period duration at a value inversely proportional to the user's smoking rate, preferably at the average interval between successive smokes over the measurement period.

14 Claims, 5 Drawing Figures

SMOKING ELIMINATION GUIDANCE SYSTEM

BACKGROUND OF THE INVENTION

This invention relates to a smoking elimination system preferably integrated into a cigarette lighter, but which also may be integrated into a matchbox, cigarette case, or the like, and having means for generating a smoker-use signal each time the user prepares to smoke a cigarette. In the case of a cigarette lighter, the signal is generated by operation of the cigarette lighter; in the case of a matchbox, the signal is generated when the matchbox is opened; and in the case of a cigarette case, the signal is generated when the cigarette case is opened or when a cigarette is removed from the case.

Various smoking elimination systems have been heretofore developed which utilize a timer which establishes a basic timing period during which a cigarette case or cigarette lighter is locked against use or operation. (For example see U.S. Pat. Nos. 3,744,953 granted July 10, 1973 to Harry C. Herr, U.S. Pat. No. 2,681,560 to V. C. Shuttleworth et al, granted June 22, 1954, and U.S. Pat. No. 2,643,527 to G. H. Harris, granted Oct. 14, 1952.) When the basic timing period is over, the cigarette lighter or box may be operated or opened to permit a single use of a cigarette involved. Sometimes, the timing period produced by the timer is manually adjustable and generally the timer must be manually reset each time a cigarette is removed from the box or a cigarette lighting operation takes place. In such a smoking elimination system, each time the user desires to smoke, he must try to operate the cigarette lighter or open the cigarette box to determine whether or not he can smoke. During a program of gradual withdrawal with such a smoking elimination system, the cigarette boxes or lighters are frequently handled numerous times without any effect, thereby frustrating the user unnecessarily. Also, when it is desired to increase the locking timing period, the user must consciously make a selection of a new timing period. Also, he may forget to reset the timer after smoking a cigarette, or he may fail to set the timing period when adjustable to an effective timing period. Moreover, a locked cigarette lighter or cigarette box can readily frustrate a user who wishes to deviate from the prescribed schedule. The inconvenience of the smoking elimination systems just described generally make them ineffective, and thus there has been a substantial need for improvements in smoking elimination systems of the type just described.

The disclosure of U.S. Pat. No. 3,424,123, granted to J. A. Giffard, Jan. 28, 1969, recognizes the advantage of a smoking elimination system which makes cigarettes readily available at all times to the user, by eliminating any locking means as described and by providing a positive indication, like the operation of a bell, to signal the user that a basic timing period is over. However, this smoking elimination system has serious disadvantages, such as a timer which must be manually reset to start a new timing period, and the requirement that the timing period must be manually varied if it is desired to increase the timing period during which the user may only smoke a single cigarette.

Accordingly, it is an object of the invention to provide a smoking elimination system which eliminates most and preferably all of the aforesaid factors of the prior art which make these devices ineffective and inconvenient to use.

SUMMARY OF THE INVENTION

The smoking elimination system of the invention guides the user, relying on his own discipline, to gradually eliminate his smoking habit. The present invention does not require the user consciously to make any manual timing period adjustment or resetting operations after each cigarette use, after the user has initiated operation of the smoking elimination system. In accordance with another feature of the invention, a timing period program where the timing periods between permitted successive cigarette uses progressively increases is established automatically at the end of an initial measuring period during which the smoking rate of the smoker is determined. A smoker utilizing the preferred form of the invention will have a smoking elimination program automatically selected with an initial timing period matching the average period between his successive cigarette uses over the measuring period and then progressively increasing automatically.

In accordance with a specific aspect of the invention, a count-down timer is preferably utilized which provides an indication to the user as to the time remaining to the end of the timing period during which the user is to smoke only one cigarette. Each time a smoker-use signal is generated, as by the operation of a cigarette lighter, the timer is automatically reset to indicate the duration of the next timing interval which indication then progressively decreases to zero again. If the user should smoke again before the timing period is over, the timer preferably is reset again to start a new timing period.

Each time the smoker-use signal is generated, while this could initiate a new timing period of a proportionately greater magnitude, in accordance with the most advantageous form of the invention the progressive increase in the timing period occurs at regular intervals, such as every four days. Also, it is believed that the increase in the smoking interval is most advantageously increased by a fixed percentage each time a smoking interval is increased. Thus, in the example of the present invention to be described the timing period is increased 10% every four days or other basic adjustment interval.

The above and other objects, advantages and features of the invention will become apparent upon making reference to the specification to follow, the drawings and the claims.

DESCRIPTION OF EXEMPLARY FORM OF THE INVENTION

Figure 1:
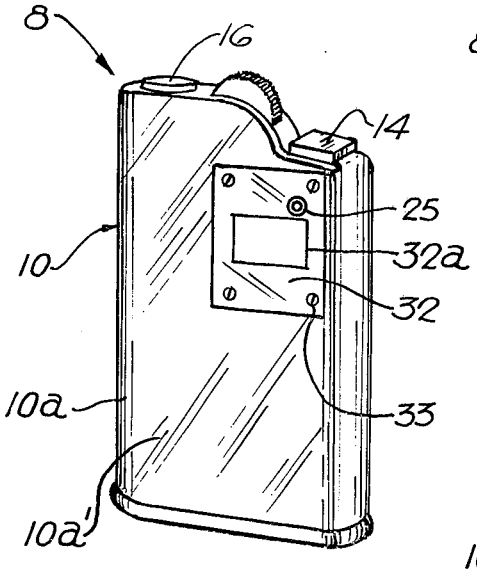
FIG. 1 is a view of a more or less conventional cigarette lighter modified to incorporate the smoking elimination guidance system of the present invention.
Figure 2:
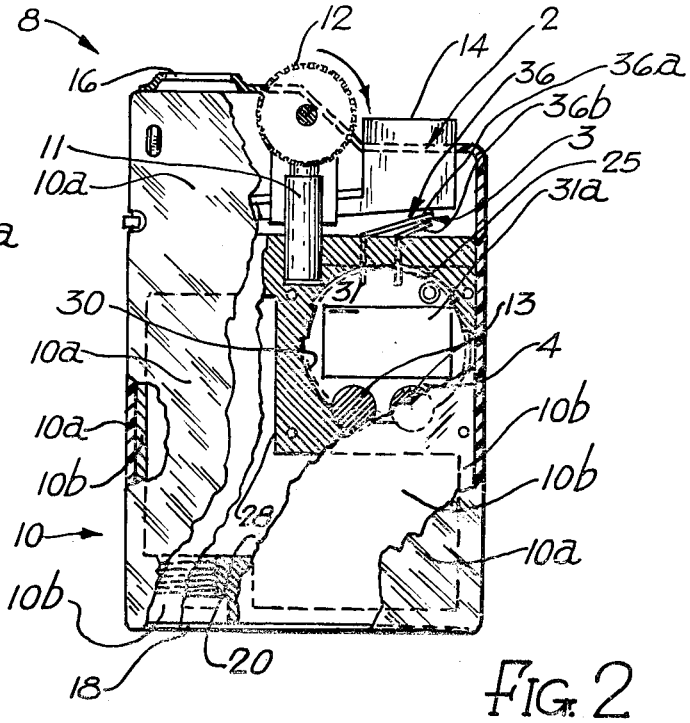
FIG. 2 is an enlarged broken-away view through the cigarette lighter shown in FIG. 1 which shows a smoking elimination guidance unit mounted within a compartment formed within the lighter fuel tank portion of the cigarette lighter of the invention.

Referring now to FIGS. 1 and 2, shown therein is a cigarette lighter 8 which may be of any suitable form but, as illustrated, is the cigarette lighter disclosed in U.S. Pat. No. 3,263,456 granted Aug. 2, 1966, and modified to incorporate the features of the invention to be described. The cigarette lighter 8 there shown includes a housing assembly 10 comprising a decorative outer casing 10*a* secured around a fuel housing 10*b* on the top of which is rotatably mounted a spark wheel 12 accessible for engagement by the thumb of the user. A depressible button 14, pivotally mounted and spaced somewhat below and to one side of the spark wheel 12, is depressed as the user pulls his thumb down across the spark wheel. Spark wheel 12 makes contact with flint protruding from spring-loaded cylinder 11. The rotation of the spark wheel 12 creates a spark which ignites fuel ejected through a nozzle (not shown) when the botton 14 is depressed. The resulting flame passes upwardly through an opening 16 at the top of the housing assembly. The fuel housing 10*b* has a fuel storage compartment 20 therein which, like the corresponding compartment in the cigarette lighter shown in said U.S. Pat. No. 3,263,456, occupies most of the volume of the fuel housing 10*b*, but, due to the addition of the present invention, is reduced in size by the addition of a compartment-forming wall 28. The fuel storage compartment 20 may be filled with the lighter fuel through a suitable filling valve 18.

The compartment-forming wall 28 is closed on one side by one of the vertical walls of the fuel housing 10*b* and opens onto the opposite side of the fuel housing to permit the reception of a smoking eliminating guidance unit 31. As shown in FIG. 2, the unit 31 includes a suitable visible liquid crystal display 31*a* which indicates to the user the time remaining of a timing period during which the smoker is only permitted to smoke a single cigarette. The unit 31 also has a depressible start button 25 which is depressed when the operation of the smoking elimination system of the invention is to be initiated. The unit 31 is powered by batteries 13.

As shown in FIG. 1, the vertical wall 10*a*' of the decorative casing 10*a* overlying the open side of the compartment 30 in the fuel housing 10*b* includes a removable panel 32 secured in any suitable way, as by screws 33, to the wall 28 of the fuel housing 10*b*. The panel 32 has a window 32*a* exposing the display 31*a* and an aperture through which the start button 25 protrudes, so that the button 25 may be depressed to start the smoking elimination system of the invention into operation.

The smoking elimination guidance unit 31 is controlled by a smoker-use signal generated by the closure of a switch 36 which may be formed by a pair of initially separated contact-forming leafs 36*a* and 36*b*. The contact-forming leafs 36*a* and 36*b* are located immediately below the depressible button 14, so that when the button 14 is momentarily depressed it will cause the leafs 36*a* and 36*b* to contact one another and generate a signal which operates the smoking elimination system of the invention in a manner to be described.

In order to best appreciate the simplicity and effectiveness of the present invention, before describing the details of the smoking elimination guidance unit 31 it would be helpful first to describe the manner in which the smoking elimination system of the invention operates. When the start button 25 is depressed various counters to be described are reset and the display 31*a* preferably displays all "0" digits. While not required in accordance with the broadest aspect of the invention, the "0" digits remain on the display 31*a* for a given measurement period, like two days, during which the unit 31 will automatically count the number of times the cigarette lighter is operated over this period to determine the smoking rate of the user of the invention. Following this measurement period, a guidance phase of the invention begins when the unit 31 will automatically be programmed to establish a series of successive single cigarette use timing periods of progressively increasing duration. At the start of each of these periods a number appears on the display 31*a* indicating the duration of the timing period. This number progressively decreases to indicate to the user the time remaining to the end of this period during which the user can only smoke a single cigarette if the selected program is to be followed. The initial timing period preferable is the average time between cigarettes smoked by the user during the two day measurement period (i.e. a number equal to the number of minutes in this measurement period divided by the number of cigarettes smoked by the user during this measurement period).

The time indicated on display 31*a* will reach zero if the user waits for the prescribed interval before operating the cigarette lighter 8. Whether or not the user operates the cigarette lighter 8 before the end of the current timing period, each such operation will reset the display 31*a* to a number indicating the length of the next timing period established by the unit 31. While the timing period could be increased each time the cigarette lighter 8 is operated, it is preferable that the timing periods increase progressively by a fixed percentage, like 10%, at regular periodic intervals, such as every four days. Means are provided in the unit 31 which automatically increase the timing periods in this manner. When the time periods have reached a given maximum duration implying that the user, for all practical purposes, has ceased or can cease smoking, the display 31*a* automatically remains at a zero indication informing the user that the smoking elimination program has ended.

It should now be apparent that the invention just described is an exceedingly easy-to-use and effective means for enabling a heavy, intermediate or light smoker to easily guide himself along a gradual smoking reduction program, without any real conscious effort other than to examine the indication on the display 31*a* to determine if he is permitted to smoke another cigarette under the gradual smoking reduction program of the invention.

It should be apparent that the present invention is useful in eliminating the smoking of cigars and pipes as well as cigarettes, and that it could be associated with a matchbox, cigar box or cigarette case where a smoker-use signal is generated as the matchbox, cigar box or cigarette case is opened. Thus, in such case switch 36 in FIG. 2 would be closed when any of these functions are carried out.

Figure 3:
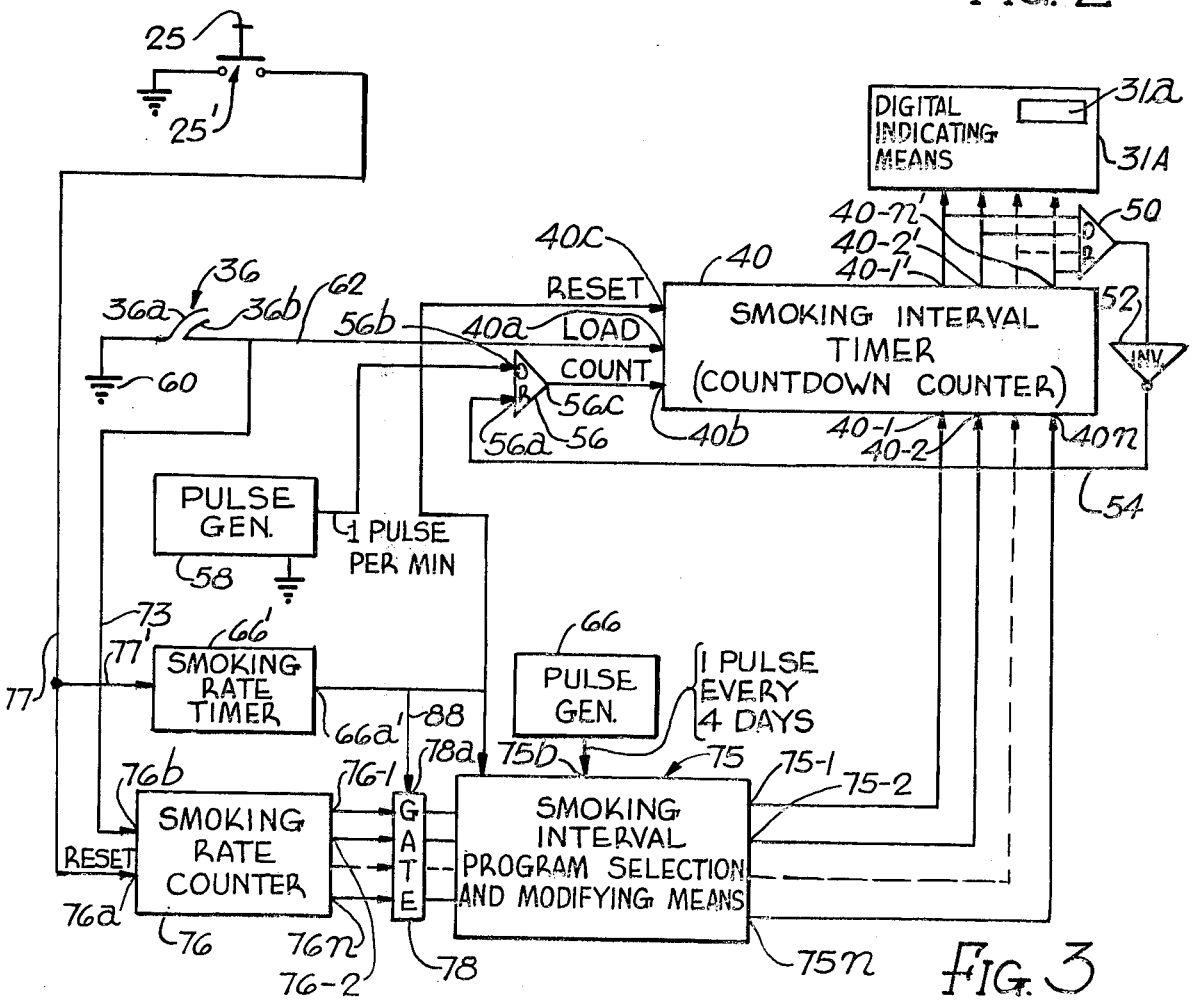
FIG. 3 is a basic block diagram showing the different basic functional components of the preferred form of the smoking elimination guidance system of the invention incorporated in the cigarette lighter shown in FIGS. 1 and 2.

Refer now to FIG. 3 which illustrates the various basic functional components forming the electrical portions of the smoking eliminating guidance unit 31. As there shown, a smoking interval timer 40 is provided which, in the most preferred form of the invention, is a count-down counter of a well known type which included a count input terminal 40*b* which receives pulses for decreasing the initially set count in the timer by one unit for each pulse fed thereto (although the timer could be a count-up counter in accordance with the broadest aspect of the invention used with an indicator which indicates the end of a timing period when the count in the counter reaches a given maximum count). The initial count fed into the timer 40 may be determined by the binary coded information fed to input terminals 40-1, 40-2 . . . 40-n thereof. The timer 40 has input count-load terminal 40*a* which receives a "0" signal, such as ground, when it is desired to transfer the particular count identified by the combination of signals fed to input terminals 40-1, 40-2 . . . 40-n into the timer 40. The count remaining in the timer 40 at any given time appears as coded information on timer output terminals 40-1', 40-2' . . . 40-n'. This information is fed to a digital indicating means 31A which includes suitable decoding circuits well-known in the art for energizing the display 31*a* which is preferably a liquid crystal display. The digital indicating means 31A is connected to timer output terminals 40-1', 40-2' . . . 40-n' so that the display 31*a* indicates the count stored in the counter at any given time.

The smoking interval timer continues to count pulses until the count reaches a given reference count, which in the case of a count-down counter would be a 0 count. Thereafter, the count-down counter 40 remains at 0 count until a count load pulse is fed to the count-load terminal 40*a*. This occurs when the cigarette lighter is used, closing the switch 36 formed by the contact-forming leafs 36*a* and 36*b*. At such time, the particular binary code present at input terminals 40-1, 40-2, . . . 40-n will then be transferred into the counter for a new count-down operation.

Figure 5:
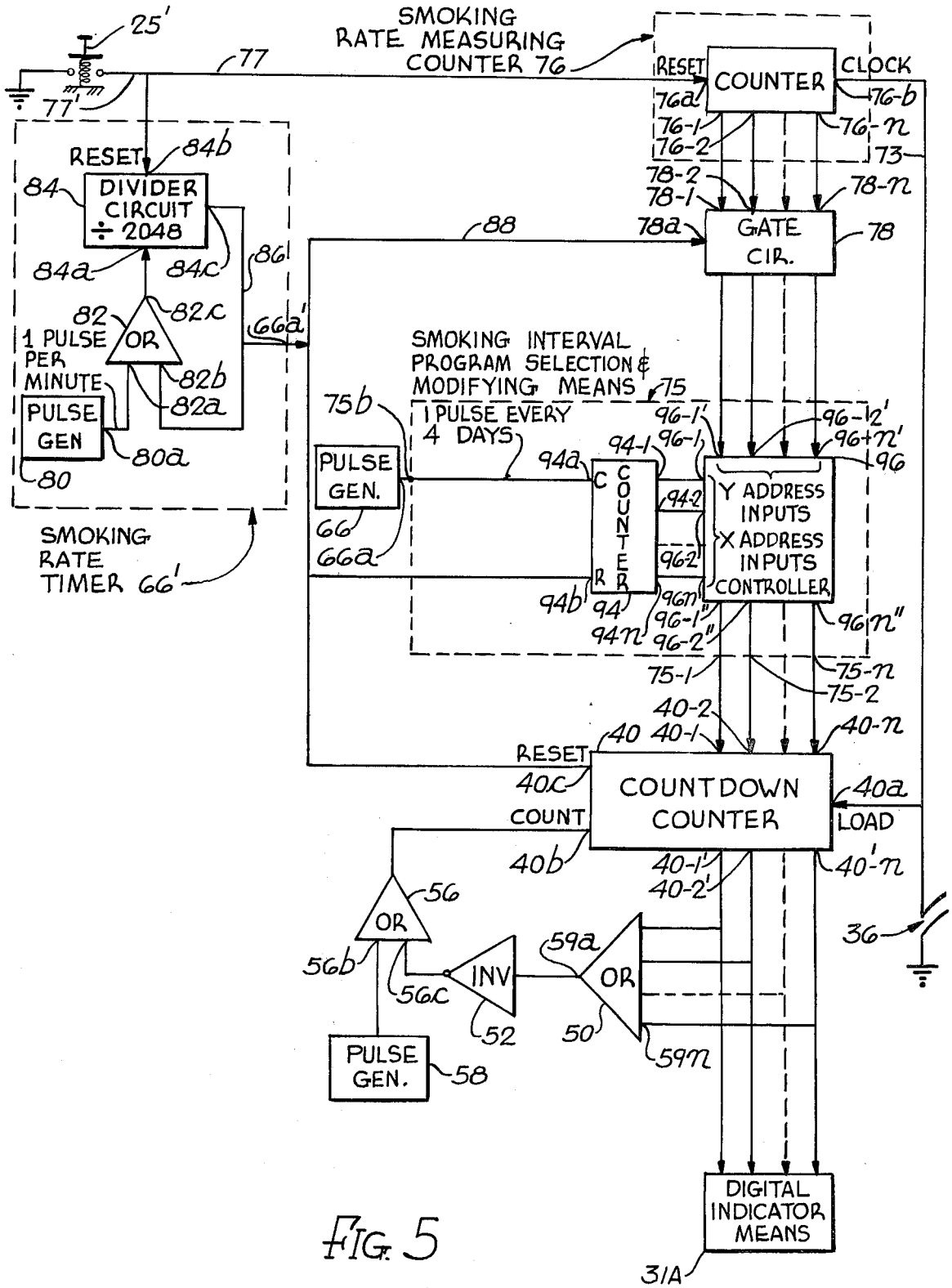
FIG. 5 is a preferred logic block diagram for the smoking elimination guidance system shown in more simplified block for in FIG. 3.

The particular manner in which the counter ceases counting when it reaches a given reference count, such as 0 in the case of a count-down counter now being described, can be accomplished in a number of ways. To make the circuit of FIG. 3 consistent with the more detailed block diagram of FIG. 5, FIG. 3 shows the output terminals 40-1', 40-2', . . . 40-n' of the counter connected to the various inputs of an "OR" gate 50 which produces a "0" output only when all the inputs thereof have a "0" signal thereon. (All of the "OR" gates to be described operate on the same logic principal as just described.) At least one of the output terminals 40-1', 40-2', . . . 40-n' will have a "1" output, except when the count in the counter 40 is zero. "OR" gate 50 will, therefore, produce a "0" output only when the count in the counter is zero. The output of the "OR" gate 50 is shown connected to the input of an inverter 52 which will invert the input signal thereto, so that the inverter 52 will only produce a "1" signal when the count in the counter 40 is zero. The output of the inverter 52 is shown extending to an input 56*a* of an "OR" gate 56 whose other input 56*b* is connected to the output of a pulse generator 48 which normally has a "1" output thereof, except during a short momentary period when the output of the pulse generator is a negative going pulse equivalent to a "0" signal. The pulse rate of this pulse generator is shown to be one pulse per minute. The "OR" gate 56 passes the one pulse per minute to the counter terminal 40*b* as long as the count in the counter is other than zero. If the count in the counter is zero, a "1" signal will be continuously fed to the input 56*a* of the "OR" gate 56, causing the counter to remain at zero count until a new load transfer signal is fed to the input terminal 40*a* of the counter 40 by the closure of lighter switch 36.

It should now be apparent that when a binary coded signal representing a desired initial count for the counter 40 is fed to the counter input terminals 40-1, 40-2, . . . 40-n, at the next operation of the cigarette lighter when the switch 36 is momentarily closed this initial count will be fed into the counter 40, and the binary coded signal at the output terminals 40-1', 40-2', . . . 40-n' thereof will correspond to the initial count of the timer, so that the "OR" gate 56 will feed pulses from the pulse generator 58 to the count terminal 40*b* of the counter 40. The count there will then progressively be reduced by one unit each time the pulse generator 58 produces a pulse, until zero count is reached again if the smoker follows the smoking eliminating program of the invention.

The initiation of the smoking rate measurement phase of the invention occurs by depression of the pushbutton 25, which operates switch means 25' which feeds reset signals on control lines 77 and 77' which are shown extending to smoking rate measuring circuit 76 and smoking rate timer 66'.

A control line 73 is shown extending from the initially ungrounded contact-forming leaf 36*b* to clock input terminal 76*a* of the smoking rate counter 76 so that the number of times the cigarette lighter is operated over a measuring period is recorded in the counter. At the end of this smoking rate measuring period, the counter 76 sends preferably a binary coded signal on a number of output lines 76-1, 76-2, . . . 76-n to a smoking interval program selection and modifying means 75 through a gate 78 then opened by a pulse fed on a line 88 to the control terminal 78*a* of the gate 78 from the smoking rate timer 66'. The smoking rate timer output is preferably also connected to the reset terminal 40*c* of the count-down counter 40 to reset the same continuously to a zero count until the control smoking rate measuring period is over. The smoking interval program selection and modifying means 75 preferably provides initially at its output terminals 75-1, 75-2, . . . 75-n a binary coded signal identifying the desired initial count to which the timer 40 is to be set in accordance with the smoking rate of the user and which identifies the initial timing period between permitted successive cigarette use. This initial period is inversely proportional to the user's smoking rate, and is preferably the average period between successive cigarette uses determined by the smoking rate counter 76. This initial binary coded signal is fed to input terminals 40-1, 40-2, . . . 40-n of the counter 40 and is transferred into the register when the cigarette lighter 8 is next operated.

The initial count-indicating signal fed to the counter input terminals 40-1, 40-2, . . . 40-n could be increased each time the cigarette lighter is operated. However, it is preferably varied independently of the operation of the lighter at regular periodic intervals, such as every four days. To this end, a pulse generator 66 may be provided which produces one pulse every given period, like every four days. The output of the pulse generator 66 is fed to an input 75*b* of the smoking interval program selection and modifying means 75, so that this pulse will increase the previous number indicated by the binary signal at the output terminals 75-1, 75-2, . . . 75-n by a desired predetermined percentage, like 10%.

Figure 4:
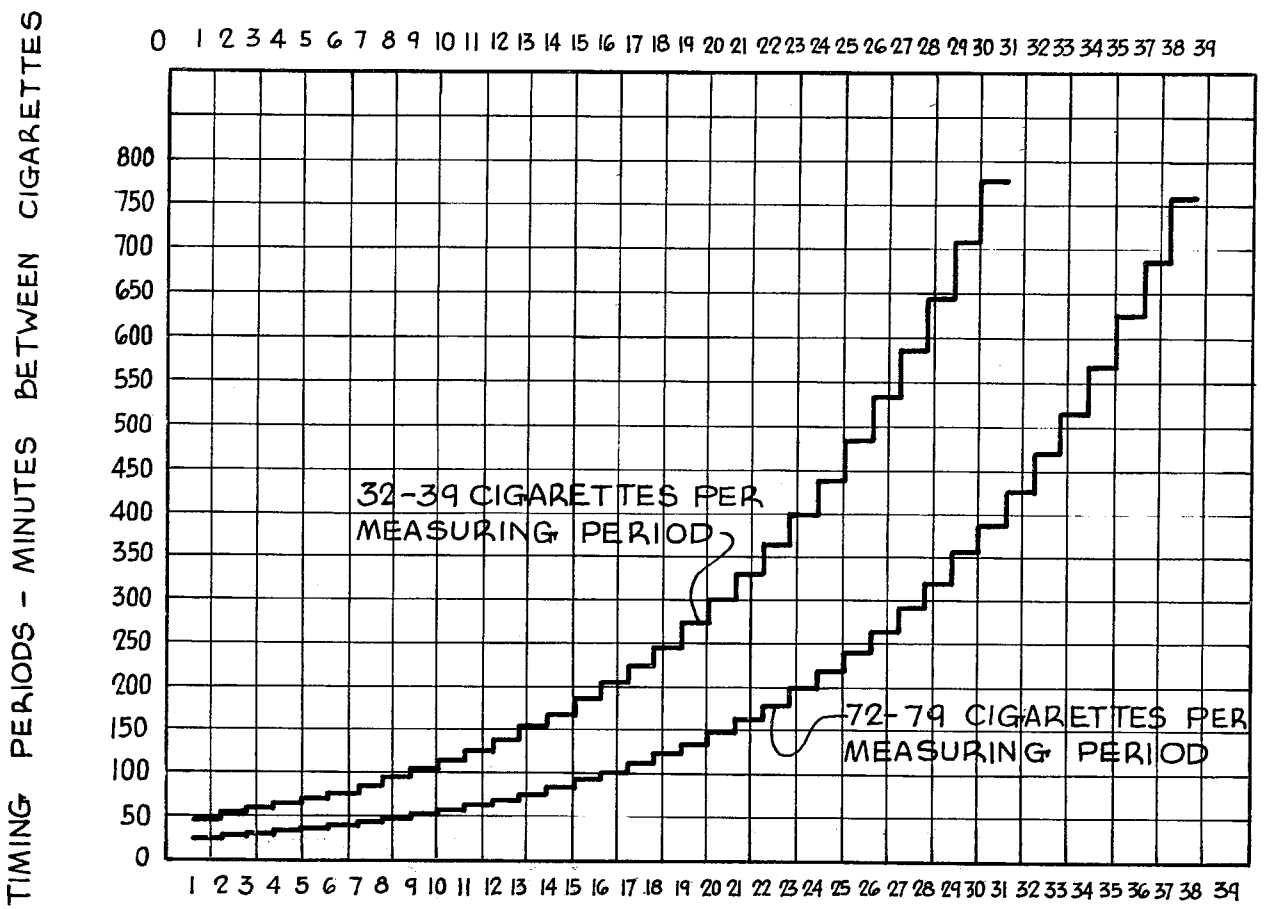
FIG. 4 illustrates two stepped waveforms representing the progressive increase in the timing periods established by the smoking elimination guidance system of the invention for two different timing programs for users respectively who smoke between 32–29 cigarettes and 72–79 cigarettes during an initial measurement period before the smoking elimination guidance phase of the invention is set into operation automatically.

The preferred variation in the timing interval number appearing at the output terminals 75-1, 75-2, . . . 75-n for two different theoretical smokers who smoke respectively 32–39 and 72–79 cigarettes per measurement period is shown in FIG. 4. As there shown, the timing period established by the control circuit described increases 10% every four days from a starting period which is inversely proportional to the number of cigarettes smoked during this measurement period. The following table I illustrates a complete smoking program established by preferred smoking eliminating guidance system for various ranges of cigarettes smoked during the measurement period referred to. Based on this information, additional curves like that shown in FIG. 4 can be readily drawn.

of the particular logic circuitry shown, will be assumed to be at a normally steady "1" state which momentarily, upon the generation of each pulse, drops to a "0" or ground signal condition. Output terminal 80*a* is connected to the input terminal 82*a* of an "OR" gate 82 whose output terminal 82*c* is connected to the input terminal 84*a* of a pulse divider circuit which divides by 2,048. When the divider circuit 84 is reset to zero by the momentary closure of the start switch 25', which applies a momentary ground to the reset input terminal 84*b* thereof, output 84*c* of this divider circuit will produce a steady "0" signal output until the divider receives 2,048 pulses (which occurs 2,048 minutes after operation of start switch 29'). Then the divider circuit output is a steady "1" signal. The output of the divider circuit 84 is connected by a conductor 86 to the other input terminal 82*b* of the "OR" gate 82. The "OR" gate

TABLE I

| Cigarettes Smoked During Measurement Period | No. of 4-Day Guidance Periods | | | | | | | | | | | | | | | | | | | |
|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 | 17 | 18 | 19 |
| 16–23 | 0 | 83 | 91 | 100 | 110 | 122 | 133 | 147 | 161 | 178 | 195 | 215 | 236 | 260 | 286 | 315 | 346 | 381 | 420 | 462 |
| 24–31 | 0 | 62 | 68 | 75 | 82 | 91 | 100 | 110 | 121 | 133 | 146 | 161 | 177 | 195 | 214 | 236 | 259 | 285 | 313 | 344 |
| 32–39 | 0 | 49 | 54 | 60 | 65 | 72 | 79 | 87 | 96 | 105 | 116 | 128 | 140 | 154 | 170 | 187 | 205 | 226 | 249 | 274 |
| 40–47 | 0 | 41 | 45 | 49 | 54 | 60 | 66 | 72 | 80 | 88 | 96 | 106 | 116 | 128 | 141 | 155 | 170 | 188 | 206 | 226 |
| 48–55 | 0 | 35 | 38 | 42 | 46 | 51 | 56 | 61 | 68 | 75 | 82 | 91 | 100 | 110 | 120 | 132 | 146 | 160 | 176 | 193 |
| 56–63 | 0 | 30 | 33 | 37 | 41 | 45 | 50 | 54 | 60 | 66 | 72 | 79 | 87 | 96 | 105 | 116 | 127 | 140 | 154 | 169 |
| 64–71 | 0 | 27 | 30 | 33 | 36 | 40 | 44 | 48 | 53 | 58 | 64 | 70 | 77 | 85 | 93 | 103 | 113 | 124 | 136 | 150 |
| 72–79 | 0 | 24 | 27 | 28 | 32 | 36 | 40 | 44 | 48 | 53 | 58 | 64 | 70 | 77 | 85 | 93 | 102 | 113 | 124 | 137 |

| Cigarettes Smoked During Measurement Period | No. of 4-Day Guidance Periods | | | | | | | | | | | | | | | | | | |
|---|---|---|---|---|---|---|---|---|---|---|---|---|---|---|---|---|---|---|---|
| | 20 | 21 | 22 | 23 | 24 | 25 | 26 | 27 | 28 | 29 | 30 | 31 | 32 | 33 | 34 | 35 | 36 | 37 | 38 |
| 16–23 | 508 | 560 | 615 | 676 | 743 | 0 | 0 | 0 | 0 | 0 | 0 | 0 | 0 | 0 | 0 | 0 | 0 | 0 | 0 |
| 24–31 | 379 | 417 | 459 | 504 | 554 | 610 | 670 | 738 | 0 | 0 | 0 | 0 | 0 | 0 | 0 | 0 | 0 | 0 | 0 |
| 32–39 | 301 | 331 | 364 | 400 | 440 | 485 | 532 | 586 | 645 | 709 | 780 | 0 | 0 | 0 | 0 | 0 | 0 | 0 | 0 |
| 40–47 | 249 | 273 | 300 | 330 | 363 | 399 | 439 | 483 | 531 | 584 | 643 | 707 | 778 | 0 | 0 | 0 | 0 | 0 | 0 |
| 48–55 | 213 | 234 | 258 | 283 | 311 | 343 | 377 | 415 | 456 | 502 | 552 | 607 | 668 | 734 | 0 | 0 | 0 | 0 | 0 |
| 56–63 | 186 | 205 | 225 | 248 | 273 | 300 | 330 | 363 | 399 | 439 | 483 | 531 | 585 | 643 | 707 | 778 | 0 | 0 | 0 |
| 64–71 | 165 | 181 | 199 | 219 | 241 | 265 | 291 | 320 | 353 | 388 | 427 | 469 | 516 | 568 | 625 | 687 | 756 | 0 | 0 |
| 72–79 | 150 | 165 | 181 | 200 | 220 | 241 | 266 | 292 | 321 | 354 | 389 | 428 | 471 | 518 | 570 | 626 | 689 | 758 | 0 |

The control circuit shown in FIG. 3 can be incorporated into an integrated circuit which includes a read-only memory section which has stored at various Y address locations representing the various cigarette ranges described the associated increasing progression of timing periods at various X address locations thereof corresponding to the four day guidance period numbers appearing in the Table I. The timing interval program modifying and selection means 75, therefore, includes the information shown in Table I stored in a read-only memory.

Refer now to FIG. 5 which illustrates a detailed block diagram of the integrated circuit referred to. Here shown are the details of exemplary logic circuits forming the smoking rate timer 66' and the smoking interval program selection and modifying means 75 to be described. The smoking rate measuring counter 76 shown therein is a scale-of-two resettable "0" signal pulse counter which has a clock pulse input 76*b* connected to the smoker use switch 36.

The smoking rate timer 66' as shown includes a pulse generator 80 which produces one pulse per minute. The output terminal 80*a* of this pulse generator 80, because

82, like the other "OR" circuits previously described, produces a "1" signal output unless both "OR" gate circuit inputs are "0" signals. It should be apparent, therefore, that when the divider circuit 84 is reset, the steady "0" output thereof results in the feeding of a continuous "0" signal to the input terminal 82*b* of the "OR" gate 82, so that the "0" pulse signal input of the pulse generator 80 will be fed through the "OR" gate 82 to the input of divider circuit 84. After the feeding of 2,048 pulses to the "OR" gate 82 changes the divider circuit output from a steady "0" to a steady "1" signal, the resulint steady "1" signal at the output of "OR" gate 82 terminates the feeding of pulses to the divider circuit 84 so that the "1" signal output thereof becomes locked-in unless the start switch 25' is again closed.

The output of the divider circuit 84 is connected to the smoker rate timer output terminal 66*a'*. The locked-in "1" output signal of the divider circuit 84 on the smoking rate timer output terminal 66*a'* is fed by conductor 88 to the control terminal 78*a* of the gate 78 to open the same, so that the output of the smoking rate measuring counter 76 will be fed to the aforementioned smoking interval program selection and modifying means 75.

As previously indicated, the smoker rate timer output terminal 66*a*′, which has a steady "0" signal thereon until the smoking rate measuring period is over, is connected to the reset terminal 40*c* of the countdown counter 40, to continuously reset the same to a zero count until after the smoking rate measuring period is over. Then the "1" locked-in signal appearing at the output terminal 66*a*′ terminates the zero resetting of the counter 40, so that subsequent operation of the smoker use switch 36 can load the counter 40 with an initial count.

Upon the operation of the start switch 25′, ground potential is fed to the reset input terminal 76*a* of the smoking rate counter 76, which can accommodate a maximum count equal to the largest number of cigarettes it is expected any smoker can smoke during the smoking rate measuring period. The pulse counter 76 has a clock input terminal 76*b* connected to the initially ungrounded leaf 36*b* of the smoker use switch 36. After the smoking rate measuring period is over, the count in the pulse counter 76 is fed through the gate 78 then opened by the "1" signal on output terminal 66*a*′, to the Y address inputs 96-1′, 96-2′, . . . 96-n′ of a controller 96.

The input terminal 75*b* of program selection and modifying means 75 is connected to pulse generator 66 which, like the pulse generator 80, will be assumed to be a pulse generator which normally has a steady "1" signal state at its output terminal 66*a* except when it generates a pulse, whereupon the output state of this pulse generator momentarily drops to a "0" or a ground signal state. The pulse generator 66 generates a pulse every four days which is fed to the clock input terminal 94*a* of a scale-of-two pulse counter 94. The pulse counter 94 has a reset terminal 94*b* which is connected to output 66*a*′ of smoking rate timer 66′. Pulse counter 94 is reset continuously during the initial smoking rate measuring period. Every four days thereafter, the count of the counter 94 will advance one count.

The pulse counter 94 has output terminals 94-1, 94-2, . . . 94-n representing the binary output of the various stages thereof to provide a binary output of the count therein. This count is fed to corresponding ROM X address inputs 96-1, 96-2, . . . 96-n of the controller 96. The controller 96 has a read-only memory storing the minute numbers in X and Y address locations corresponding to the count numbers in the X and Y address locations of Table I. The controller 96 feeds to the output terminals 96-1″, 96-2″, . . . 96-n″ thereof in binary code form, the number representing in minutes the information stored in the selected X and Y address location of the ROM memory shown in the Table I. This number is fed to the aforementioned count input terminals 40-1, 40-2, . . . 40-n of the countdown counter 40 which operates in the manner previously described.

The present invention has thus provided an exceedingly useful smoking elimination guidance system incorporated in a cigarette lighter or the like which, after an initial smoking rate measuring period, automatically establishes a smoking elimination program suitable to the particular smoker involved, without any effort on the part of the user other than his depression of the start pushbutton 25. Then, when the smoker next uses the cigarette lighter, the number indicated on the display 31*a* thereof is the number of minutes to the end of the current timing interval during which the smoker is not to smoke another cigarette, cigar or the like. The presence of a zero reading on the display 31*a* will indicate that the user may smoke another cigarette, cigar or the like. This timing interval indicated after each use of the cigarette lighter progressively increases, like every four days, so that after a number of months the period between successive smokes is so long that he can easily quit smoking altogether.

It should be understood that numerous modifications may be made in the most preferred form of the invention described without deviating from the broader aspects of the invention.

I claim:

1. A smoking elimination system comprising: smoker-use signal generating means for generating a smoker-use signal each time the use of a cigarette or the like is to be initiated by the user; timing means responsive to the generation of each smoker-use signal for initiating a new predetermined timing period during which only a single use of a cigarette or the like is to be permitted; indicator means for indicating to the user the end of the current timing period established by the timing means; and timing period modifying means for automatically at various times progressively increasing the timing periods initiated by the generation of said smoker-use signals so that the timing intervals between successive uses of a cigarette or the like progressively increase to a point where the smoker can readily stop smoking.

2. The smoking elimination system of claim 1 wherein said timing period modifying means progressively increases the timing periods established by said timing means at predetermined intervals independently of the particular instants of time said smoker-use signals are generated.

3. The smoking elimination system of claim 1 wherein there is provided smoking rate measuring means responsive to said smoker-use signals over a measurement period for providing a measurement of the number of cigarettes or the like which are used during said measurement period; and said timing period modifying means being responsive to said smoking rate measuring means for operating said timing means to provide initial and immediate subsequent timing periods having a length inversely proportional to the measurement of said smoking rate measuring means.

4. The smoking elimination system of claims 1, 2 or 3 wherein the system is incorporated into a cigarette lighter, said smoker-use signal generating means automatically generating a momentary smoker-use signal each time said cigarette lighter is operated.

5. The smoking elimination system of claim 1 wherein said indicator means provides a visible indication as to the time interval remaining until the end of the currently established timing period provided by said timing means.

6. The smoking elimination system of claims 1, 2, or 3 wherein said timing means is a count-down counter, said timer period modifying means including means for setting an initial count in said counter proportional to the desired timing period involved.

7. The smoking elimination system of claim 1 wherein said indicating means provides an indication to the user of a number which indicates the length of time remaining until the end of the timing period involved.

8. The smoking elimination system of claims 1, 2, or 3 wherein said smoker-use signal generating means operates automatically to produce said signal whenever the user takes a cigarette from a container or box, removes a match from a matchbox, lights a cigarette lighter, or the like, and there is provided start switch means for initiating operation of the smoking eliminating system, whereby the only control provided in said smoking elimination system for operation by the user is said start switch means initiating operation of the entire smoking elimination system, so that thereafter the system operates automatically without any further control operations required by the user other than lighting of a cigarette lighter, removing a cigarette from a container or box, or removing a match from a matchbox or the like.

9. A smoking elimination system comprising: smoker-use signal generating means for generating a smoker-use signal each time the use of a cigarette or the like is to be initiated by the user; counter means for receiving signal pulses to be counted thereby; a source of signal pulses to be fed to said counter means; gate means between said signal pulses and said counter means for controlling the feeding of pulses to the counter means; means for closing said gate means when the counter means has a given count therein; timing period modifying means for establishing automatically progressively varying counter reset numbers representing progressively increasing timing periods; means responsive to the generation of a smoker-use signal for resetting and transferring into said counter means the current counter reset number established by said time period modifying means so that said counter means will reach said given count in a time corresponding to the current desired timing period; and indicator means responsive to the count in said counter means which reaches the ultimate permitted count for indicating to the user that the end of a current timing period has occurred so that the user is informed that he can then smoke another cigarette or the like.

10. The smoking elimination system of claim 9 wherein said counter means is a count-down counter, and said indicator means gives a continuous indication of the count in said counter representing the time remaining to the end of the current timing period.

11. The smoking elimination system of claim 10 wherein said timing period modifying means establishes a change in said counter reset number at predetermined intervals independently of the particular instants of time said smoker-use signals are generated.

12. The smoking eliminating system of claim 9 wherein there is provided smoking rate measuring means responsive to said smoker-use signals over a given measurement period by providing a measurement of the number of cigarettes or the like which are used during said measurement period; said timing period modifying means being responsive to said smoking rate measuring means for establishing automatically counter reset numbers which start at a value inversely proportional to the number of cigarettes or the like which are used during said measurement period in which thereafter progressively increases to a point where the smoker can readily stop smoking.

13. The smoking eliminating system of claim 1 or 12 wherein an initial period of said timing means has a duration equal to the average interval between successive cigarette or the like uses during an initial measurement period.

14. The smoke eliminating system of claims 1, 2 or 9, wherein said smoker-use signal generating means operates automatically to produce said signal whenever the user takes a cigarette from a container or box, removes a match from a matchbox, lights a cigarette lighter, or the like and there is provided start switch means for initiating operation of the smoking eliminating system.

* * * * *